US006182776B1

(12) United States Patent
Åsberg

(10) Patent No.: US 6,182,776 B1
(45) Date of Patent: Feb. 6, 2001

(54) OVERBURDEN DRILLING APPARATUS HAVING A DOWN-THE-HOLE HAMMER SEPARATABLE FROM AN OUTER CASING/ DRILL BIT UNIT

(75) Inventor: Bengt Åsberg, Åshammar (SE)

(73) Assignee: Sandvik AB, Sandviken (SE)

( * ) Notice: Under 35 U.S.C. 154(b), the term of this patent shall be extended for 0 days.

(21) Appl. No.: 09/326,678

(22) Filed: Jun. 7, 1999

(30) Foreign Application Priority Data

Jun. 12, 1998 (CA) ..... 2-240 559

(51) Int. Cl.[7] ..... E21B 17/00
(52) U.S. Cl. ..... 175/300; 175/320; 175/414
(58) Field of Search ..... 166/242.6; 175/300, 175/306, 414, 417, 320, 171; 403/348, 349; 279/19, 93

(56) References Cited

U.S. PATENT DOCUMENTS

| | | | | |
|---|---|---|---|---|
| 1,033,187 | * | 7/1912 | Metzger | 403/349 |
| 2,862,738 | * | 12/1958 | Bayley | 403/349 |
| 3,612,191 | * | 10/1971 | Martini | 173/136 |
| 4,632,195 | * | 12/1986 | Emmerich | 403/348 |
| 4,919,221 | * | 4/1990 | Pascale | 175/415 |
| 5,107,944 | * | 4/1992 | Gustafsson | 175/296 |
| 5,131,476 | * | 7/1992 | Harrington | 173/17 |
| 5,255,960 | | 10/1993 | Ilomäki . | |
| 5,261,758 | * | 11/1993 | Vranish | 403/348 |
| 5,590,726 | | 1/1997 | Jarvela et al. . | |
| 5,803,187 | * | 9/1998 | Javins | 175/57 |
| 6,035,953 | * | 3/2000 | Rear | 175/171 |

FOREIGN PATENT DOCUMENTS

| | | | | |
|---|---|---|---|---|
| 3731630 | * | 3/1989 | (DE) | 175/320 |
| 96703 | * | 3/1989 | (NL) | 175/320 |

* cited by examiner

*Primary Examiner*—David Bagnell
*Assistant Examiner*—Nathan Mammen
(74) *Attorney, Agent, or Firm*—Burns, Doane, Swecker & Mathis, L.L.P.

(57) ABSTRACT

Overburden drilling equipment for drilling a hole includes a down-the-hole hammer formed by a cylinder and a piston reciprocating in the cylinder due to pressurized water being directed alternately to the upper and lower ends of the piston. Each downward stroke inflicts an impact blow upon an anvil portion of a drill bit extending upwardly within the lower portion of the cylinder. A drill chuck is mounted at a lower end of the cylinder to receive the drill bit. A generally cylindrical casing shoe is attached to a casing and is rotatably connected to the drill bit to be longitudinally advanced thereby during drilling operation. The drill chuck includes at least one key which defines the largest radius of the drill chuck. The casing includes a diametrically reduced portion which has at least one keyway therein. The key and the diametrically reduced portion retain the hammer longitudinally in relation to the drill bit.

9 Claims, 4 Drawing Sheets

OVERBURDEN DRILLING APPARATUS HAVING A DOWN-THE-HOLE HAMMER SEPARATABLE FROM AN OUTER CASING/ DRILL BIT UNIT

TECHNICAL BACKGROUND

The present invention relates to a drilling equipment, a driver sub and a drill bit for overburden drilling operations.

PRIOR ART

Overburden drilling equipment is previously disclosed, for example, in llomäki U.S. Pat. No. 5,255,960 issued Oct. 26, 1993. It has been found favorable to construct overburden drilling equipment such that the casing and the rock drill bit are relatively rotatable while simultaneously axially connected, so that the drill bit pulls the casing along as the drill bit advances in the ground. The solution to such relative rotation is described in the abovenamed patent as a "lap-joint", wherein the casing, or a casing shoe attached to the front of the casing, axially overlaps the drill bit. A split collar welded to the inside of the casing projects into a circumferential groove formed in the drill bit, enabling the drill bit to pull the casing along. Often, it is desirable for the casing to be left in the hole, but that is not possible with the known device.

It is furthermore known through for instance Jarvela U.S. Pat. No. 5,590,726 to leave the casing in the hole by unlatching a pilot drill bit from a ring bit of the casing and to retract the pilot bit and the hammer. However, in deep hole drilling the ring bit tends to wear out prematurely, i.e., the ring bit wears out before-the desired depth is reached. Thus the entire casing has to be retracted to change the ring bit for resuming the drilling operation.

OBJECTS OF THE INVENTION

One object of the present invention is to provide a down-the-hole hammer and a drill bit which include the advantages of prior art while obviating the above-mentioned drawbacks.

Specifically one object of the present invention is to provide efficient drilling equipment able to drill deeply into rock while casing the hole.

Another object of the present invention is to provide a drill bit for a down-the-hole hammer which provides for long drilling lengths.

Still another object of the present invention is to provide efficient drilling equipment, wherein the hammer is releaseably connected to a non-retractable one-piece road embankment drill bit.

SUMMARY OF THE INVENTION

One aspect of the present invention relates to an overburden drilling equipment for drilling a hole. The equipment comprises a cylindrical casing defining a longitudinal axis and having a diametrically reduced structure forming at least one longitudinally extending keyway. A drill bit is disposed in the casing and includes a cutting face located at a longitudinal front end thereof, and an anvil portion located at a longitudinal rear portion thereof. A generally cylindrical casing shoe is attached to the casing and mounted to the drill bit for longitudinal movement therewith. The drill bit is rotatable relative to the shoe. A down-the-hole hammer is disposed in the casing. The hammer includes a cylinder, and a piston reciprocable in the cylinder due to hydraulic fluid being directed alternately to upper and lower ends of the piston to effect its reciprocation in the cylinder. Each downward stroke inflicts an impact blow upon the anvil portion of the drill bit which extends upwardly within the lower portion of the cylinder. The cylinder is rotatable relative to the casing. A drill chuck is mounted at a lower end of the cylinder and receives an upper portion of the drill bit. The drill chuck includes at least one key defining a largest radius of the drill chuck and sized to pass longitudinally through the at least one keyway. The hammer and the drill chuck are separable from an assembly comprised of the casing, the casing shoe and the drill bit by rotating the cylinder to align the at least one key with the at least one keyway and raising the hammer.

Another aspect of the invention relates to a percussive drill bit adapted to be connected to a down-the-hole hammer. The drill bit is generally symmetrical about a rotational axis thereof and comprises a drill body having a shank and a head and a fluid passage formed therein for conducting flushing fluid to a front drilling face of the head. Button inserts are located in the front drilling face. The shank includes external projections for receiving rotational driving movement, and an anvil located at a free end of the shank for receiving axial impacts applied against the drill bit. Between the anvil and the projections, the shank forms an intermediate surface which is free from any recesses and retainers.

Yet another aspect of the invention relates to a driver sub which is adapted for transmitting rotary forces in a down-the-hole hammer. The driver sub comprises a cylindrical body having a central through-bore extending completely therethrough coaxially with respect to a longitudinal center axis of the body. A screw thread structure is formed along a portion of an outer peripheral surface of the body. The through-bore has a plurality of circumferentially spaced, axially extending projections. The body has a flange at a lower portion thereof. The flange carries at least one key which extends radially inwardly.

DESCRIPTION OF THE DRAWINGS

The objects and advantages of the invention will become apparent from the following detailed description of a preferred embodiment thereof in connection with the accompanying drawings, and in which.

DETAILED DESCRIPTION OF A PREFERRED EMBODIMENT OF THE INVENTION

Figure 1A:
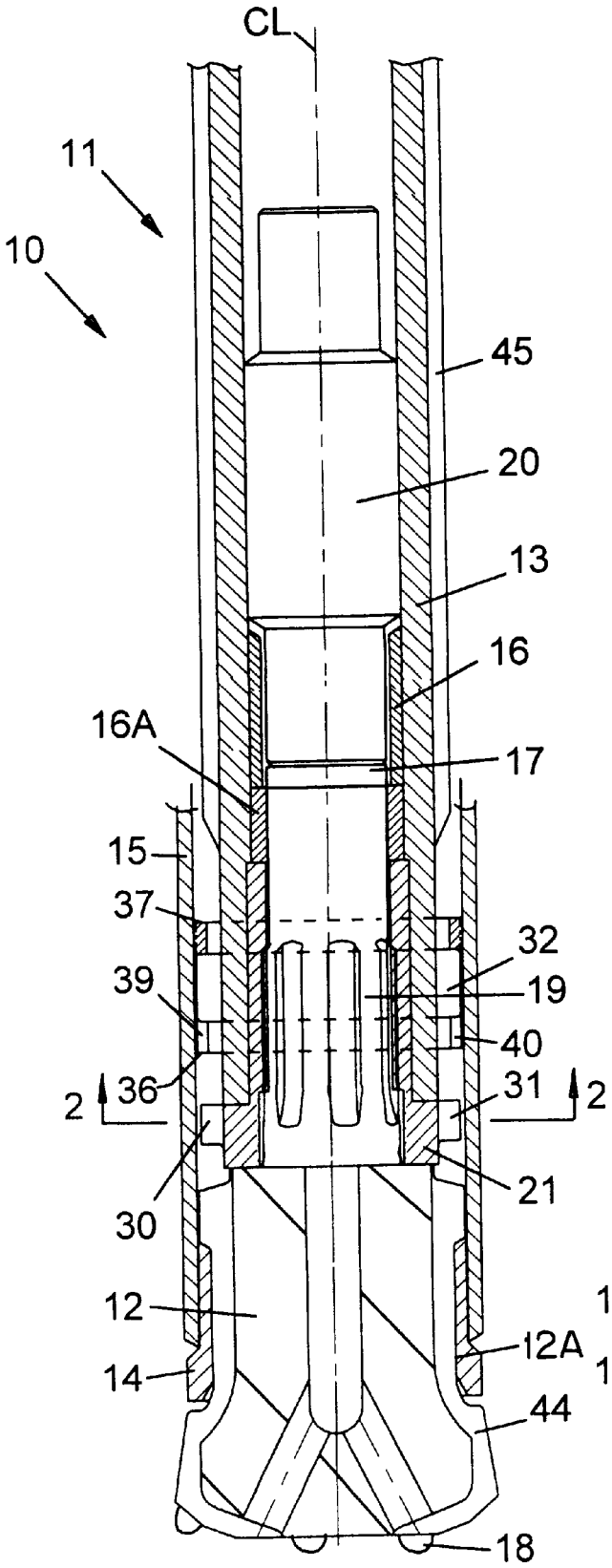
FIGS. 1A, 1B, 1C and 1D show a down-the-hole hammer according to the present invention in a longitudinal section taken along line 3—3 in FIG. 2, in first, second, third and fourth positions, respectively.
Figure 1B:
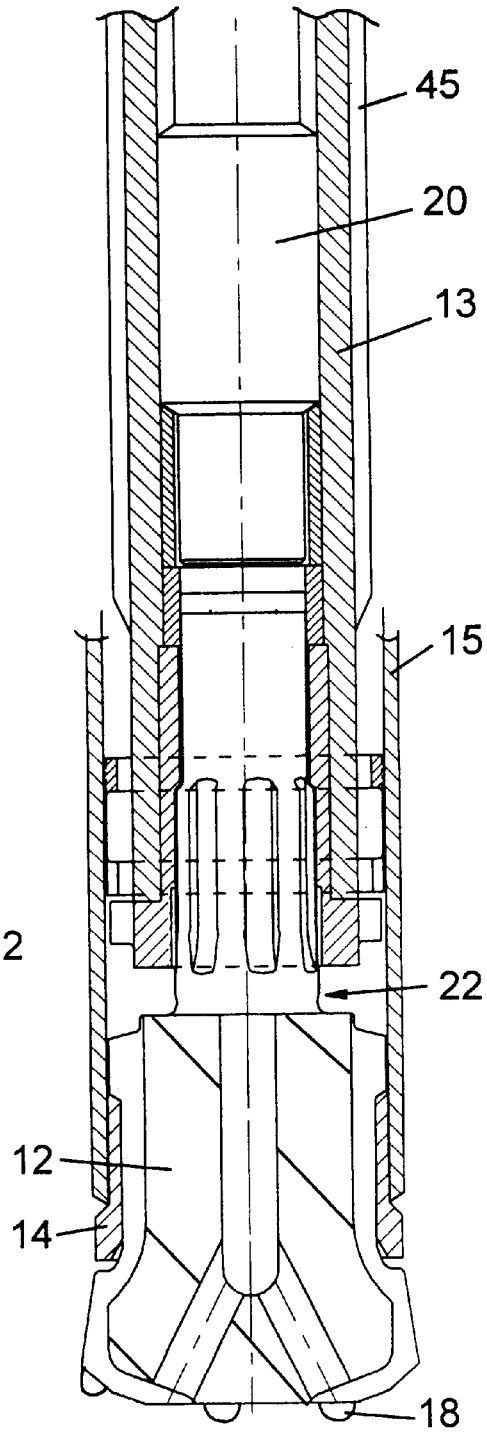

In FIGS. 1A–1D there is shown a preferred embodiment of overburden drilling equipment according to the present invention. The equipment 10 comprises a down-the-hole hammer 11, a drill bit 12, a casing shoe 14 and a casing 15.

The hammer 11 is a hydraulic, preferably water-driven, hammer as disclosed in U.S. Pat. No. 5,107,944 issued Apr. 28, 1992, the disclosure of which is incorporated by reference herein. The water-driven hammer drives a percussive drill bit 12. The down-the-hole hammer 11 is connected to a drill string, not shown. The drill string comprises a number of double leads, high pressure drill tubes duly sealed in the thread areas. A water-driven hammer will not affect the surrounding soil as much as air-driven tools with respect to erosion, oil pollution and noise. For example, with respect to erosion, the speed of water required to drive a water-driven hammer is about 1 m/s as compared to an air-driven hammer wherein the air speed is about 20 m/s. Furthermore, in a water-driven hammer, the hammer will not be heated.

The rearward end of the hammer 11 is provided with a drive piston 20 reciprocable in a cylinder 13. The front end of the piston is guided for reciprocation in a bearing 16 located adjacent an anvil 17 of the drill bit and produces axial impacts against the drill bit 12. Between the cylinder 13 and the bearing 16 the hammer can be elongated and enlarged diametrically relative to the piston. A port, not shown, is provided in said rear end for supplying pressurized hydraulic fluid from the drill string. The enlarged piston portion reciprocates freely in a chamber formed by the cylinder 13. The cylinder is mounted to the front end of the drill string. The drill bit is slidably received by a cylindrical sleeve 16A located at the rear end of a driver sub 21 and by the driver sub 21 itself. The driver sub 21 is threaded at the front end of the cylinder 13 and has a channel extending longitudinally therethrough. Drive water is expelled from the cylinder and flushes the hole drilled by the bit 12. The hammer is free from any retaining means for holding the drill bit.

The percussion drill bit 12 is generally symmetrical about its rotational axis CL and includes a drill body having a fluid passage 23 formed therein for conducting flushing fluid to a front drilling face of the drill bit. In the front drilling face a number of button inserts 18 are located. The button inserts 18 are made of cemented carbide and are secured in borings preferably by press fit. The steel drill body has external splines 19 disposed on the shank 22. The splines shall be connected to corresponding splines in the driver sub 21, so as to transfer rotational movement.

Normally in prior art equipment of this type, a circumferentially extending external groove would be provided in the drill bit 12 below the anvil 17 for receiving a collar or retainer ring; the collar is meant to cooperate with axially spaced walls facing longitudinally rearwardly and forwardly, respectively, and extending substantially perpendicular to the axis CL.

In the present invention, however, the shank 22 of the drill bit has a cylindrical rear portion or intermediate surface 24 positioned between the anvil 17 and the splines 19. The intermediate surface 24 is contiguous without any grooves or retaining means, FIG. 1D. Thus, since the shank is groove-free it provides for an endurable drill bit having a longer life while being less expensive to manufacture. Instead of a conventional internal retainer ring, the hammer according to the present invention has an external retainer means through co-operation between the drill bit 12 and the casing 15/casing shoe 14.

The drill bit is connected to the casing shoe 14 in a manner allowing relative rotational movement between the drill bit 12 and the casing shoe 14 about the rotational axis CL. The casing shoe is rigidly connected to the casing 15, preferably by means of a weld. The casing shoe 14 comprises two substantially identical, mirror-imaged halves. Longitudinal edges of the halves are prepared for welding by being shaped as longitudinally extending bevels for receiving a weld.

Figure 2:
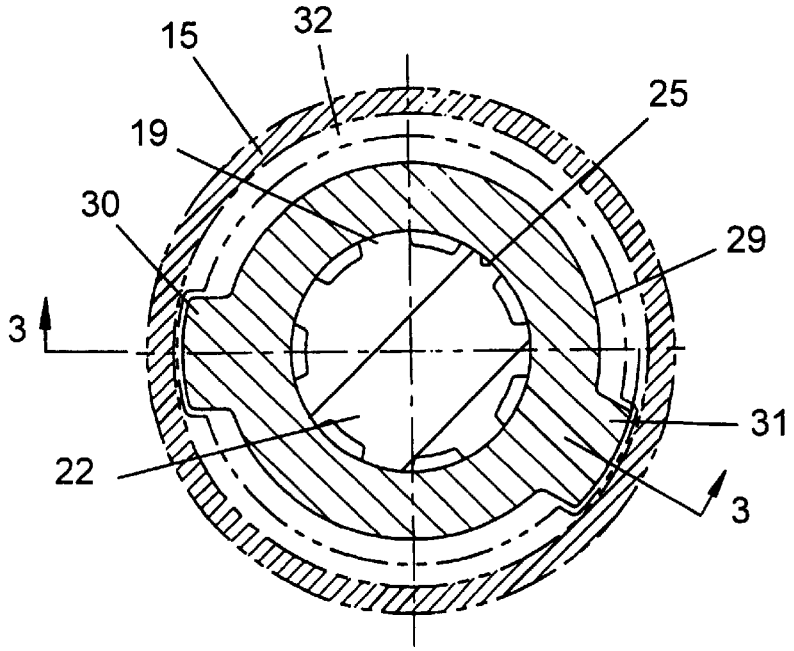
FIG. 2 shows a section of the hammer taken along line 2—2 in FIG. 1A.
Figure 3:
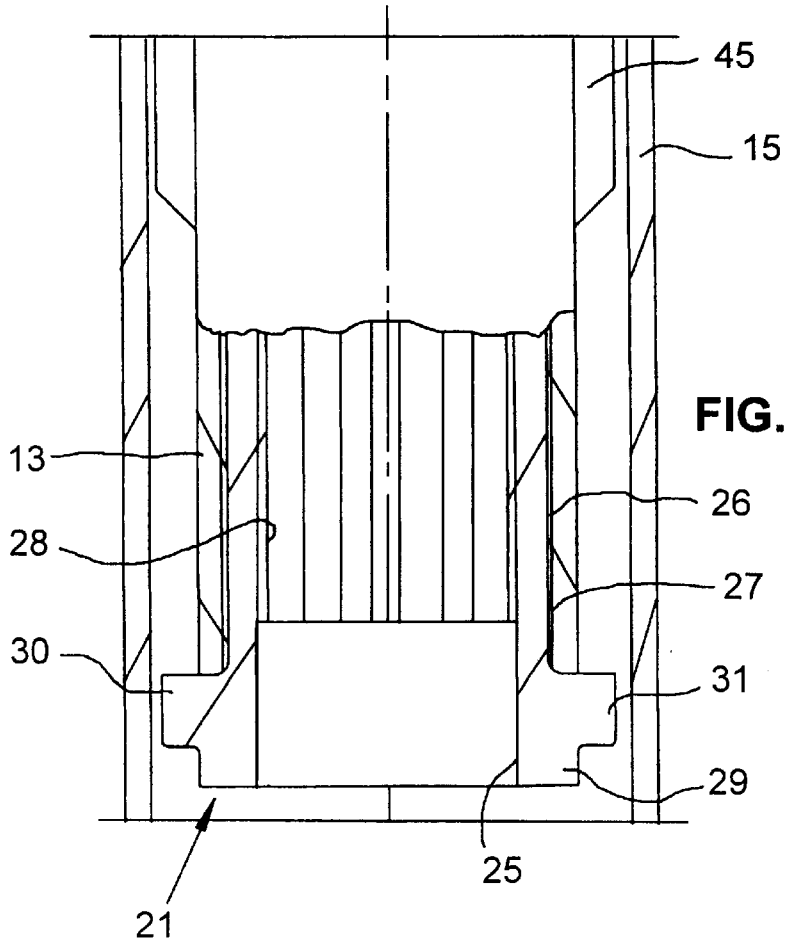
FIG. 3 shows an enlarged section of the hammer shown in FIG. 1D.

The driver sub or drill chuck 21, FIGS. 2 and 3, is provided for transmitting rotary forces to the drill bit 12 in the down-the-hole hammer. The sub 21 comprises a cylindrical body having a central through-bore 25 extending completely therethrough coaxially with respect to a longitudinal center axis CL of the body, and a screw thread structure 26 formed along a portion of an outer peripheral surface 27 of the body. The through-bore 25 has a plurality of axially extending projections 28 such as splines. The sub comprises a flange 29 at a lower portion of the sub facing towards the drill bit head. The flange is connected to at least one key 30, 31 or projecting portion, which extends radially beyond the flange. Each key defines the largest radius of the driver sub. Preferably, the sub comprises two keys at the lower portion. The keys 30, 31 are spaced apart circumferentially by an angle of less than 180°, preferably about 150°.

Figure 4A:
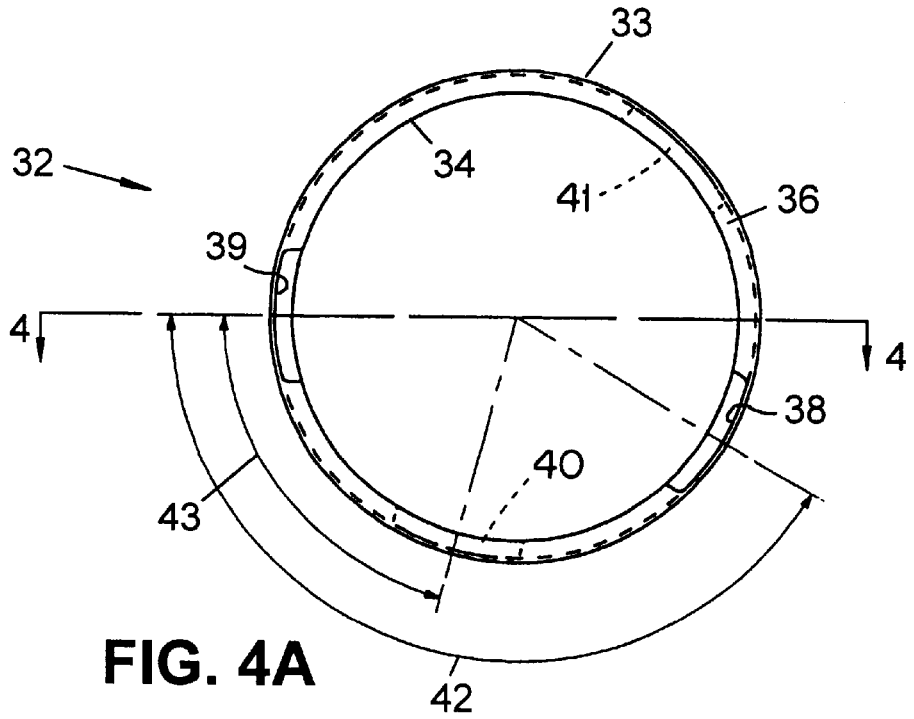
FIGS. 4A and 4B show a one-piece ring in opposite plan views.
Figure 4C:
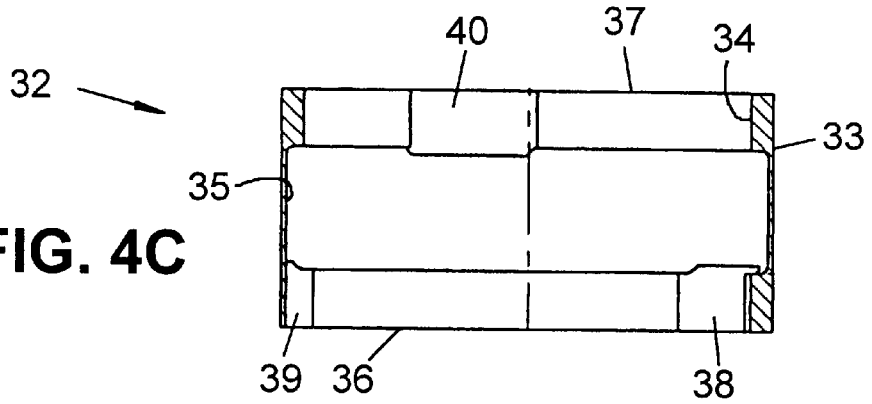
FIG. 4C shows a section of the one-piece ring taken along line 4—4 in FIG. 4A.
Figure 4B:
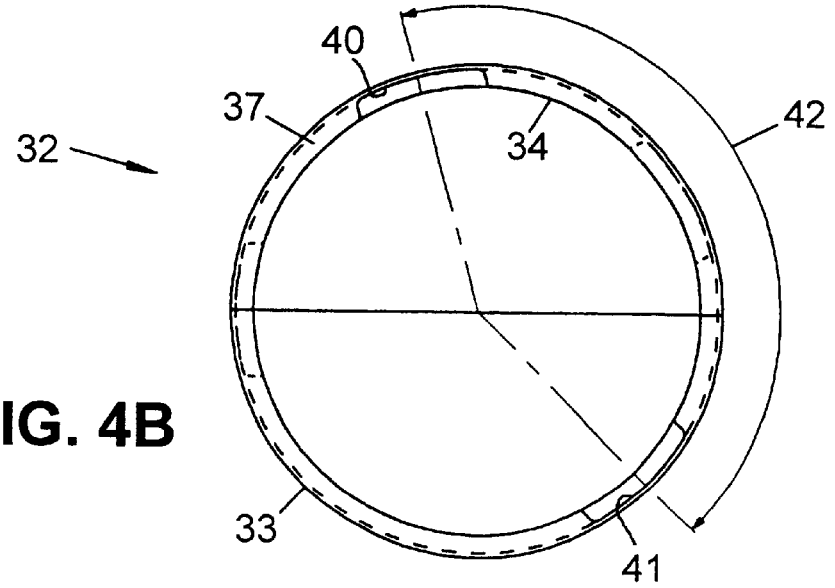

A diametrically-reduced structure in the form of a one-piece ring 32 (FIGS. 4A–4C) is welded to the internal wall of the casing 15 at a certain distance from the casing shoe 14. The ring 32 has a peripheral surface 33 and an internal surface 34. A central circumferential recess 35 is provided internally in the ring. The recess 35 defines two portions, i.e., one lower portion 36 and one upper portion 37, each portion having thicker wall thickness than the wall thickness in the area of the recess 35. The portions 36, 37 are axially opened by circumferentially spaced keyways 38–41 (i.e., keyways 38 and 39 disposed in the lower portion 36, and keyways 40 and 41 disposed in the upper portion 37) to allow the keys 30, 31 of the driver sub to pass therethrough. The keyways in each portion 36, 37 are identical and spaced circumferentially apart by an angle 42 less than 180°, preferably about 150°. The keyways 38, 39 in the lower portion 36 are circumferentially offset relative to the keyways 40, 41 in the upper portion 37 by an angle 43 less than 90°, preferably about 75°.

The drilling equipment is mounted in the following way. The ring 32 is welded to the internal wall of the casing 15 at a suitable distance upwardly (rearwardly) from the casing shoe 14. Preferably, said distance is larger than the diameter of the casing. The casing shoe 14 halves are rotatably secured in the groove 12A of the drill bit 12. The drill bit and the shoe 14 are inserted through the free end of the casing such that a flange of the shoe abuts the rim of the casing. Then the shoe is welded to the rim of the casing. The drill bit is now secured to the casing 15 for rotation therewith. Then the hammer 11, which carries the driver sub 21, is connected to a drill string component and inserted into the opposite free end of the casing.

Preferably the cylinder 13 of the hammer has a plurality of guiding wings 45 to guide the hammer within the casing. The hammer is lowered in the casing such that the through-bore 25 receives the shank 24 of the bit and until the keys 30, 31 abut the upper portion 37 of the ring 32. Then the hammer is rotated until the keys are able to enter the keyways 40, 41 in the ring. When the keys enter the keyways the hammer can be further lowered and rotated such that the splines 19, 28 mesh and then the keys abut the lower portion 36 of the ring 32. The drill bit is rotatable with the hammer at this stage. Then the hammer is rotated until the keys are able to enter the keyways 38, 39 in the ring such that the hammer can be lowered until the end surface of the driver sub 21 abuts a shoulder of the drill bit head. Then the drilling equipment is ready for drilling.

When a drill rig has been positioned at the drilling site, with the drilling equipment connected to a rotation unit of the drill rig, a valve is opened such that high pressurized water from a pump, pressurized up to 80 to 200 bar, will run through a water channel in the drill string and into the hammer 11. The piston 20 of the hammer will then impact on the rear end 17 of the drill bit 12, thereby transferring shock waves to the bit buttons impacting on the soil or the rock. Spent drive water is used to cool the drill bit and to remove drill cuttings in front of the drill bit upwardly through grooves 44 in the periphery of the drill bit and into the casing 15 outside of the hammer and the drill string and further to the surface. When additional tool length is required, the water supply is cut off via a valve and a new drill tube is mounted, usually every 2 m.

Figure 1C:
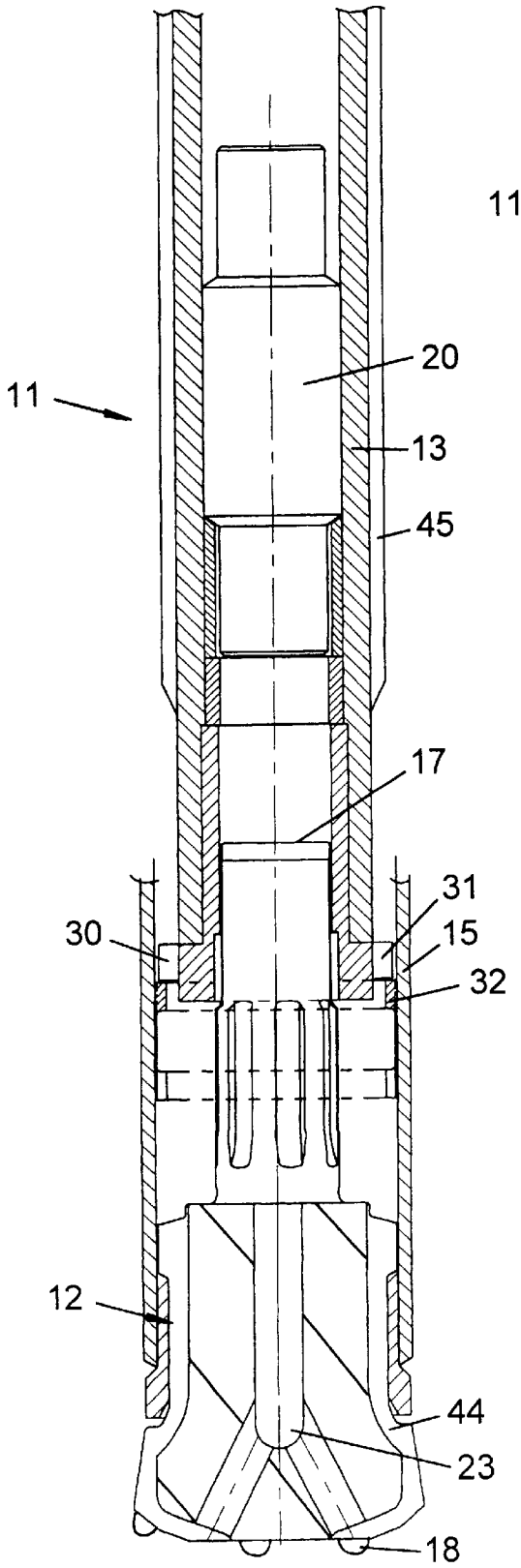
Figure 1D:
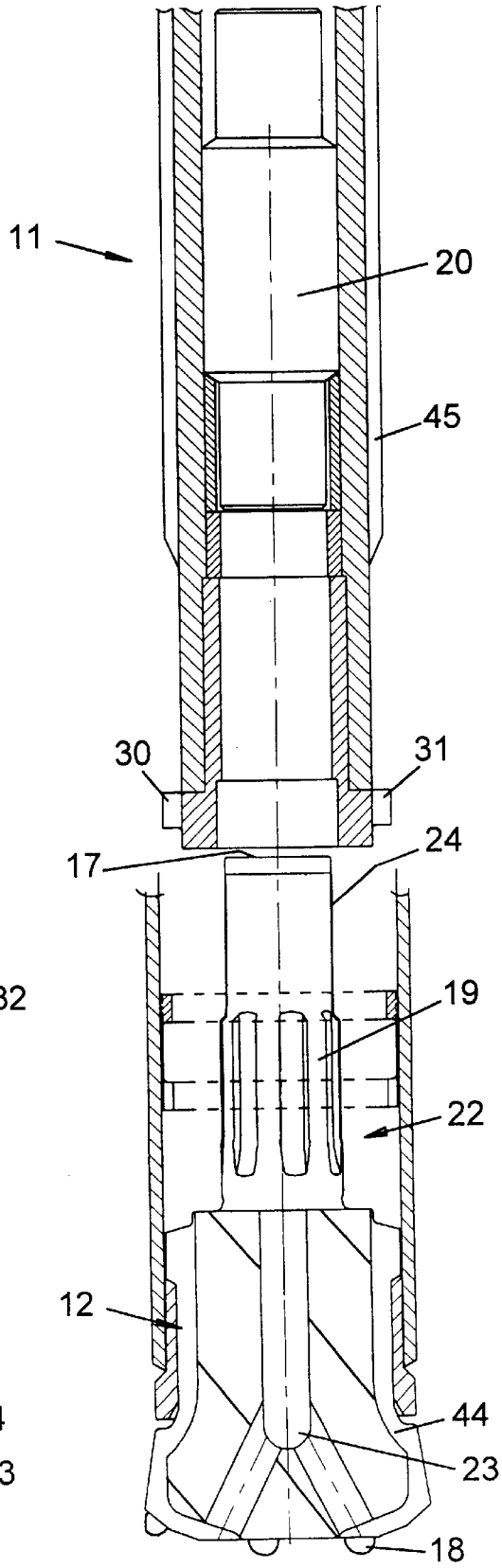

Referring now again to FIG. 1A, the drilling operation mode is shown when the cylinder 13 end surface abuts the shoulder of the drill bit 12 and the piston 20 reciprocates within the cylinder 13 and impacts on the anvil 17. The shock waves through the drill bit propagate to the buttons to crush the rock and also propagate to the casing shoe 14 to advance the casing 15 while the hammer is rotated by the drill string. The keys 30, 31 are inactive during drilling. When drilling has been completed or when free flow of fluid to flush the drill bit is desirable, the hammer 11 is retracted (raised) until the keys 30, 30 abut the lower portion of the ring 32, as in FIG. 1B. If the back-pressure in the bore is expected to exceed a certain level it is preferable to have applied a packer device, not shown, in the casing above the hammer, which packer device seals the casing when the hammer is in the position of FIG. 1B. The upper portion 37 of the ring 32 serves as a safety stop if the keys 30, 31 directly run through the keyways 39, 40 in the lower portion 36. The safety stop is desirable when the packer device is used. In FIG. 1C the hammer has been lifted and rotated such that the keys 30, 31 have run through the openings 38–41, while in FIG. 1D the hammer has been completely separated from the drill bit for complete recovery of the hammer and the drill string. The drill bit 12 is retained by the casing 15.

The general idea of the drilling equipment according to the present invention is to drill a hole with the equipment and to leave the assembly comprised of the drill bit, the casing shoe and the casing in the hole by uncoupling the hammer from the drill bit before retracting the hammer. It would be possible to retract the entire equipment if the ground around the casing is of such a nature as to remain stable after retraction of the equipment. In drilling of a road embankment it is possible to retract the hammer when the casing is visible at the exit side and to cut off the casing behind the drill bit, reweld it to a new casing and resume drilling another bore with the same drill bit.

It should be noted that the present invention provides numerous additional advantages relative to prior art devices. In comparison to known ring bits, the more solid drill bit according to the present invention having many cemented carbide buttons endures longer drilling intervals.

The invention can be varied freely within the scope of the appended claims. Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. An overburden drilling equipment for drilling a hole, comprising:

a cylindrical casing defining a longitudinal axis and having a diametrically reduced structure forming at least one keyway extending longitudinally therethrough;

a drill bit disposed in the casing and including a cutting face located at a longitudinal front end thereof, and an anvil portion located at a longitudinal rear portion thereof;

a generally cylindrical casing shoe attached to the casing and mounted to the drill bit for longitudinal movement therewith, the drill bit being rotatable relative to the shoe;

a down-the-hole hammer disposed in the casing, the hammer including a cylinder, and a piston reciprocable in the cylinder due to hydraulic fluid being directed alternately to upper and lower ends of the piston to effect reciprocation thereof in the cylinder, each downward stroke inflicting an impact blow upon the anvil portion of the drill bit which extends upwardly within the lower portion of the cylinder, the cylinder being rotatable relative to the casing;

a drill chuck mounted at a lower end of the cylinder and receiving an upper portion of the drill bit, the drill chuck including at least one key defining a largest radius of the drill chuck and sized to pass longitudinally through the at least one keyway, the hammer and the drill chuck being separatable from an assembly comprised of the casing, the casing shoe, and the drill bit by rotating the cylinder to align the at least one key with the at least one keyway and raising the hammer.

2. The equipment according to claim 1 wherein the diametrically reduced structure is configured to retain the hammer in two longitudinally spaced positions relative to the casing.

3. The equipment according to claim 1 wherein the diametrically reduced structure includes an upper portion and a lower portion spaced a distance below the upper portion, each of the upper and lower portions having at least one keyway whereby the upper and lower portions respectively define the two longitudinally spaced positions of the hammer.

4. The equipment according to claim 3 wherein the at least one keyway of the upper portion is circumferentially offset with respect to the at least one keyway of the lower portion.

5. The equipment according to claim 4 wherein there is a plurality of keyways in each of the upper and lower portions and spaced circumferentially apart by a first angle less than 180°, each keyway of the upper portion being circumferentially offset from a respective keyway of the lower portion by a second angle less than 90°.

6. The equipment according to claim 5 wherein the first angle is about 150°.

7. The equipment according to claim 5 wherein the second angle is about 75°.

8. The equipment according to claim 3 wherein the upper and lower portions of the diametrically reduced structure define upper and lower portions, respectively, of a common ring member.

9. The equipment according to claim 1 wherein the at least one key is of one-piece integral construction with the drill chuck.

* * * * *